United States Patent [19]

Aigner

[11] Patent Number: 4,892,026

[45] Date of Patent: Jan. 9, 1990

[54] HAND-HELD AUTOMATIC FIREARM

[75] Inventor: Friedrich Aigner, St. Valentin, Austria

[73] Assignee: Steyr-Daimler-Puch AG, Postrach, Austria

[21] Appl. No.: 241,854

[22] Filed: Sep. 8, 1988

[30] Foreign Application Priority Data

Sep. 22, 1987 [AT] Austria ..... 2393/87

[51] Int. Cl.[4] ..... F41C 5/00

[52] U.S. Cl. ..... 89/140; 89/142

[58] Field of Search ..... 89/140, 141, 142

[56] References Cited

U.S. PATENT DOCUMENTS

| | | | |
|---|---|---|---|
| 2,388,443 | 11/1945 | Ruger . | |
| 3,724,325 | 4/1973 | Silsby | 89/142 |
| 4,664,015 | 5/1987 | Kennedy | 89/142 |

FOREIGN PATENT DOCUMENTS

| | | | |
|---|---|---|---|
| 734985 | 5/1943 | Fed. Rep. of Germany | 89/140 |
| 112208 | 7/1965 | Netherlands | 89/141 |
| 572440 | 10/1945 | United Kingdom | 89/140 |
| 1119782 | 7/1968 | United Kingdom . | |

*Primary Examiner*—Charles T. Jordan
*Assistant Examiner*—Stephen Johnson
*Attorney, Agent, or Firm*—Marmorek, Guttman & Rubenstein

[57] ABSTRACT

A hand-held automatic firearm comprises a trigger mechanism, which includes a hammer, arranged to be cocked as the breechblock recoils, a sustained-fire lever, controlled by the breechblock and locks the hammer as the breechblock advances, a trigger slider, movable by the trigger against spring force from an initial position to a single-shot position and further to a sustained-fire position, and a pair of mutually cooperating levers, which respectively constitute a release member and a disconnector member and are adapted each to enter the path of movement of a hammer extension and to assume a position that depends on the position of the trigger slider. The release lever and the disconnector lever are pivoted on a common upright pivot and have respective confronting camming side edges, which define between them a cam slot. A camming member is movable by the trigger slider and extends into said cam slot. The camming member moves in engagement with said camming edges as the trigger is pulled and by said movement causes pivotal movement of the pair of levers against the force of a restoring spring from an initial position, in which the release lever engages the hammer extension of the hammer when it is cocked, to a single-shot position, in which the release lever releases the hammer extension and the disconnector lever enters the path of said extension, and further to a sustained-fire position, in which the levers of said pair are disengaged from the hammer extension.

6 Claims, 4 Drawing Sheets

HAND-HELD AUTOMATIC FIREARM

BACKGROUND OF THE INVENTION

1. Field of the Invention

This invention relates to a hand-held automatic firearm comprising a trigger mechanism, a hammer, which is arranged to be cocked as the breech-block recoils, a sustained-fire lever, which is controlled by the breechblock and locks the hammer as the breechblock advances, a trigger slider, which is movable by the trigger against spring force from an initial position to a single-shot position and further to a sustained-fire position, and a pair of mutually cooperating levers, which respectively constitute a release member and a disconnector member and are adapted each to enter the path of movement of a hammer extension and to assume a position that depends on the position of the trigger slider.

2. Description of the Prior Art

Firearms which comprise a firing hammer and such trigger mechanism can be operated in a sustained-fire mode, in which the hammer is cocked by the breechblock as it recoils and the cocked hammer can be locked by the sustained-fire lever until the advancing breechblock has been locked, whereafter the sustained-fire lever under the control of the breechblock releases the hammer and the hammer strikes forwardly and by means of a firing pin fires the cartridge. In the sustained-fire mode that operation is continually repeated as long as the trigger remains pulled and only when the trigger is released do the disconnector and release members become effective so that just as during the single-shot mode they catch the cocked hammer and independently of the sustained-fire lever do not release the cocked hammer until the trigger is pulled again. In the single-shot mode the hammer is released by a movement of the release member as it engages a hammer extension from above and the disconnector member simultaneously enters the path of that hammer extension and during the next recoil automatically catches the hammer in its cocked position so that only one shot can be discharged. Upon the release of the trigger, the release member is moved rearwardly so that it again engages the hammer extension from above and the disconnector member leaves the path of the hammer extension when the release member has engaged the hammer extension. In the prior art, the release member and the disconnector member consist of generally upright levers, which are pivoted on transverse axes or consist of vertical sliders. That arrangement involves a considerable overall height and requires a substantial distance between the grip of the firearm and the line of recoil action. Besides, the handling of the firearm will be difficult and the accuracy of fire which can be achieved will be adversely affected.

SUMMARY OF THE INVENTION

It is an object of the invention to eliminate said disadvantages and to provide a hand-held automatic firearm which is of the kind described first hereinbefore and comprises a trigger mechanism which distinguishes by having a low overall height and a short length and consisting of relatively simple parts, which can economically be manufactured and in which firearm the trigger can reliably be pulled without a risk of trouble.

That object is accomplished in accordance with the invention in that the release lever and the disconnector lever are pivoted on a common upright pivot and have respective confronting camming side edges, which define between them a cam slot, a camming member is provided, which is movable by the trigger slider and extends into said cam slot, the camming member is arrnged to move relative to the camming edges of the cam slot and in engagement with said edges as the trigger is pulled and by said movement to pivotally move the pair of levers against the force of a restoring spring from an initial position, in which the release lever engages the hammer extension of the hammer when it is cocked, to a single-shot position, in which the release lever releases the hammer extension and the disconnector lever enters the path of said extension, and further to a sustained-fire position, in which levers of said pair are disengaged from the hammer extension. In that arrangement the release lever and the disconnector lever constitute horizontal scissors, which have a very small height and length and permit an exact operation owing to a relatively simple camming mechanism. A reliable cooperation of all parts will be ensured because the levers are pivotally moved in a horizontal path into the path of the hammer extension and the relatively large area in which the catching surfaces of the levers and the hammer extension overlap each other even if the manufacturing tolerances are relatively large. The configuration of the camming edges and the movement of the slider, which is coupled to the trigger slider, are so selected, that the release lever and the disconnector lever can easily be moved relative to each other and relative to the path of the hammer extension when the trigger slider is in its single-shot or sustained-fire position so that the lever constitute robust and functionally satisfactory elements which can satisfactorily perform their required functions as a release member and a disconnector member in the single-shot and sustained-fire modes.

In accordance with a desirable feature of the invention the camming member preferably consists of a roller and is mounted on a camming lever, which at one end is pivoted on an axis that is parallel to the axis of rotation of the pair of levers, whereas the camming lever at its other end extends into a coupling slot of the trigger slider. That arrangement will be simple in design and will ensure the required transmission of motion between the trigger slider and the camming member because a displacement of the trigger slider will positively impart a pivotal movement to the camming lever, which by that pivotal movement will move the camming member along an arc of a circle so that it will reliably perform its camming function.

Within the scope of the invention that catching surface of the disconnector lever, which surface faces the hammer extension, may be offset to the direction of the striking movement of the hammer from the catching surface of the release lever. In that case the control of the hammer when it is caught by the disconnector lever will reliably be taken over by the release lever, which owing to its offset catching surface can reliably perform an inward pivotal movement until it is in its catching position in the path of the hammer extension before the disconnector releases the hammer extension so that the latter is then retained only by the release lever.

A simple arrangement will also be provided if the restoring spring consists of a torsional coil spring for urging the levers of the pair toward each other and a safety device is provided for locking the release lever in its initial position. The torsional coil spring will then ensure a satisfactory cooperation of the camming edges and the camming member and the safety device will prevent an undesired pivotal movement of the release lever from its initial position under the action of shakes.

The safety device may desirably consist of a two-armed locking lever, which is mounted on the camming lever for a stop-limited pivotal movement against spring force, and said locking lever may comprise a first lever arm, which protrudes into the path of movement of the hammer extension, which has a slip-off surface on the side that is remote from the breechblock, whereas the other lever arm of said locking lever has an indentation which interlocks with the release lever when the camming lever is in its initial position. When the camming lever is in its initial position, a mechanical locking of the release lever will be ensured in that arrangement and the release lever will automatically be released when the camming lever is pivotally moved for the discharge of a round. But in order to ensure that the release lever will not be blocked as the hammer moves rearwardly and that the engagement of the hammer extension by the release lever will not be prevented, the locking lever will be pushed aside by the hammer as it is cocked and the safety device will be disabled for a short time so that the release lever can move its catching surface out of the path of the hammer extension and a satisfactory cocking of the hammer and the catching of the hammer by the disconnector lever will not be prevented.

DETAILED DESCRIPTION OF THE PREFERRED EMBODIMENT

Figure 1:
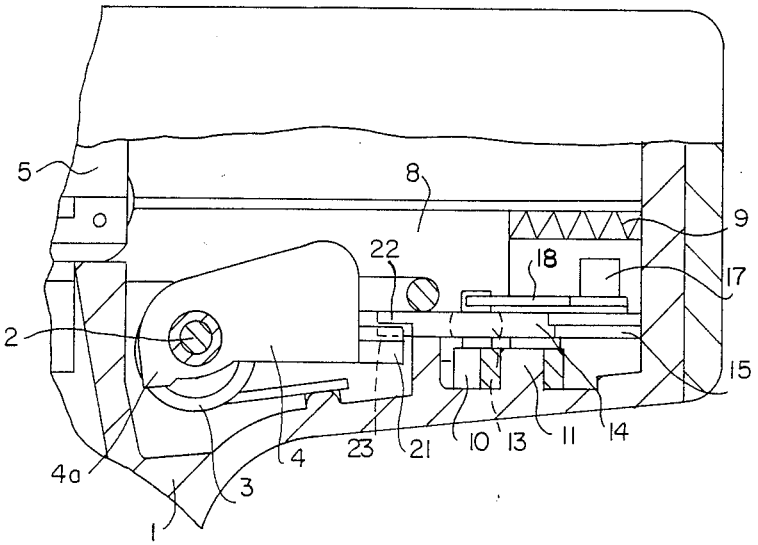
FIG. 1 is a fragmentary vertical sectional view taken on line I—I in FIG. 2 and shows a part of a hand-held automatic firearm that comprises a trigger mechanism in accordance with the invention.

An illustrative embodiment of the invention is strictly diagrammatically shown in the drawing.

A hand-held automatic firearm comprises a receiver 1, which contains a trigger mechanism. The trigger mechanism comprises a hammer 4, which is pivoted on a horizontal transverse pivot 2 and is biased by a hammer spring 3. During the recoil of the breechblock 5, which is shown only in part, the hammer 4 is cocked. During the advance of the breechblock the hammer is locked by a breechblock-controlled sustained-fire lever 6 in that a hook portion 7 of the lever 6 engages a catching nose 4*a* of the hammer from below.

The receiver 1 also contains a trigger slider 8, which is guided in the receiver 1 for a displacement against the force of a trigger spring 9 from an initial position to a single-fire position and to a sustained-fire position. By known means which are not shown in detail, the trigger slider 8 is operatively connected to the trigger 8*a*. By means of the trigger slider 8, a pivotal movement is imparted to a camming lever 10, which is pivoted at one end on a vertical pivot 11 and at its other end extends into a coupling slot 12 of the trigger slider 8. A camming roller 13 is mounted on the camming lever and extends into a cam slot 16, which is defined by and between a pair of levers 14, 15. Said pair of levers are composed of a release lever 14 and a disconnector lever 15 and are pivoted on a common vertical pivot 17. A torsional coil spring 18 urges the levers 14, 15 toward each other. In dependence on the position of the trigger slider 8, a movement of the camming roller 13 relative to the cam slot 16 which is defined by the camming side edges 19, 20 of the pair of levers 14, 15, the pair of levers 14, 15, which respectively serve as release and disconnector members, will perform the control movements which are required for single shots and for sustained fire.

Figure 2:
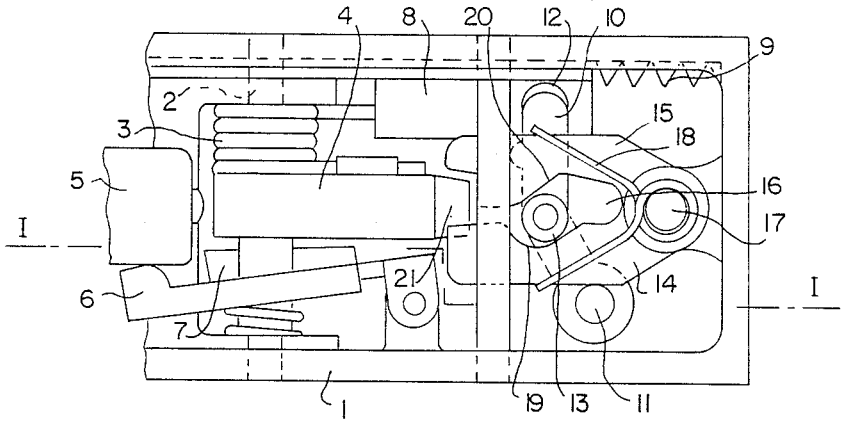
FIG. 2 is a fragmentary top plan view showing the same firearm with the receiver cover removed to expose parts of the trigger mechanism.
Figure 1A:
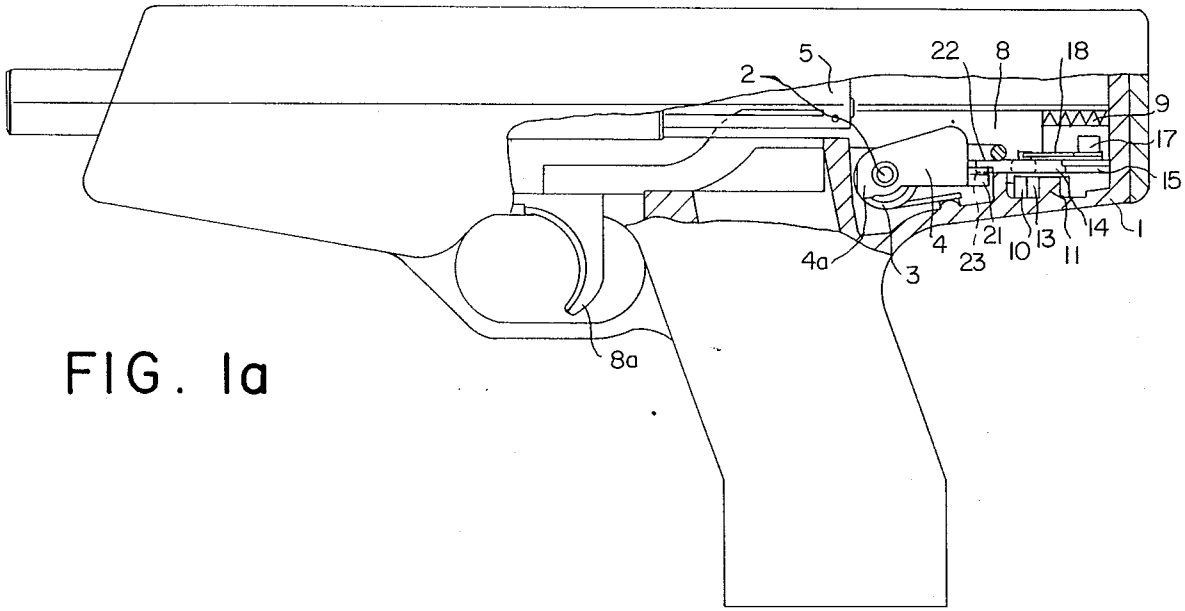
FIG. 1*a* shows a side view, partly in section, of a hand-held firearm embodying the invention.

In the initial position shown in FIG. 2, the breechblock 5 is in its foremost position and the sustained-fire lever 6 has disengaged the cocked hammer 4, which is now caught because the catching surface 22 of the release lever 14 engages a hammer extension 21 from above. The catching surface 23 of the disconnector lever 15 is now disposed outside the path of the hammer extension 21. The firearm is ready to fire.

Figure 3:
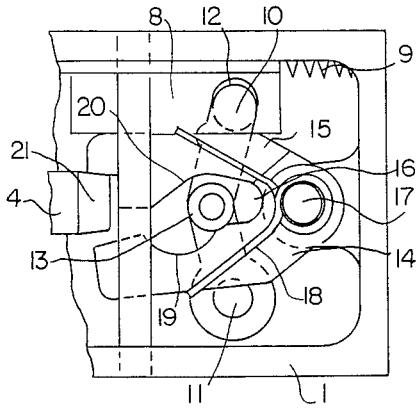
FIGS. 3 to 5 are top plan views, which are similar to FIG. 2 and show the trigger mechanism with the trigger in different positions.
Figure 4:
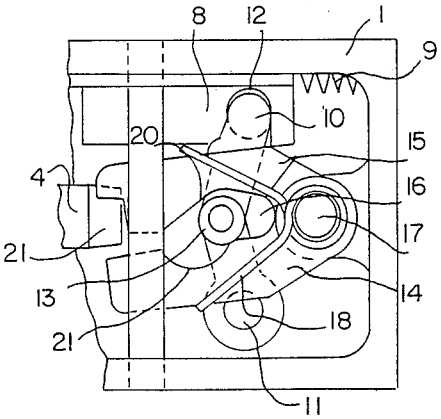

When the trigger slider 8 is then pushed to its single-fire position against the force of the trigger spring 9 and is locked in that position by detent or locking means, not shown, the camming lever 10 will perform a pivotal movement about the pivot 11 and will cause the camming roller 13 to urge the release lever 14 outwardly so that the hammer 4 is released and can cause the shot to be discharged. (FIG. 3). As soon as the hammer extension 21 has jumped up will the restoring spring 18 urge the disconnector connector lever 15 inwardly into the path of the hammer extension 21. As a result, the hammer 4 which has been cocked again by the recoiling breechblock will displace during its reverse pivotal movement the disconnector lever 15 by the hammer extension 21, which has a suitable slip-off surface. The disconnector lever 15 then immediately returns to its catching position (FIG. 4). When the breechblock 5 has advanced and the hammer 4 has subsequently been released by the sustained-fire lever 6, the catching surface 23 of the interruptor lever 15 will catch the hammer extension 21. As long as the trigger is pulled, a second round cannot be discharged and the next round cannot be discharged until the trigger is released and is then pulled again. Upon a release of the trigger, the trigger spring 9 will urge the trigger slider 8 back to its initial position, and the camming roller 13 will then perform a reverse pivotal movement to urge the disconnector lever 15 away from the hammer extension 21 so that the control of the hammer 4 will pass from the disconnector lever 15 to the release lever 14, which has been swung in the meantime. To ensure a satisfactory transfer of the control, the respective catching surfaces 22, 23 of the release lever and the disconnector lever 14, 15 are offset in elevation as is apparent from FIG. 1. After the control of the hammer 4 has been taken over by the release lever 14, the hammer 4 is retained only by the release lever 14 (FIG. 2) so that the next round can now be discharged.

Figure 5:
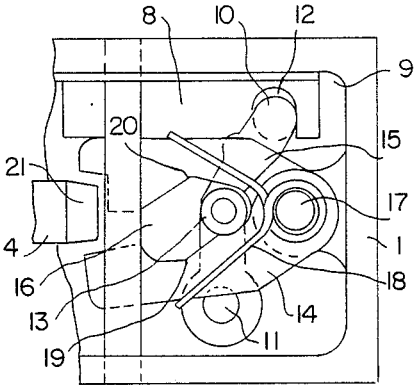

For sustained fire, the trigger slider 8 must be moved beyond its single-fire position to its sustained-fire position shown in FIG. 5 so that a sufficiently large pivotal movement is imparted to the camming lever 10 and the camming roller 13 now moves the levers 14, 15 apart until the hammer extension 21 has entirely been released. Now the locking and release of the hammer 4 will be controlled only by the sustained-fire lever 5 and the fire will be sustained as long as the trigger is pulled. Upon a release of the trigger slider 8 returns to its initial position and the camming roller 13 again permits the pair of levers 14, 15 to influence the sequence of movements of the trigger mechanism. During the next reverse pivotal movement of the hammer 4 the hammer extension 21 will be engaged by the disconnector lever 15 and the control of the hammer extension 21 will subsequently be passed on to the release lever 14. The mechanism has been returned to the initial position shown in FIG. 2.

Figure 6:
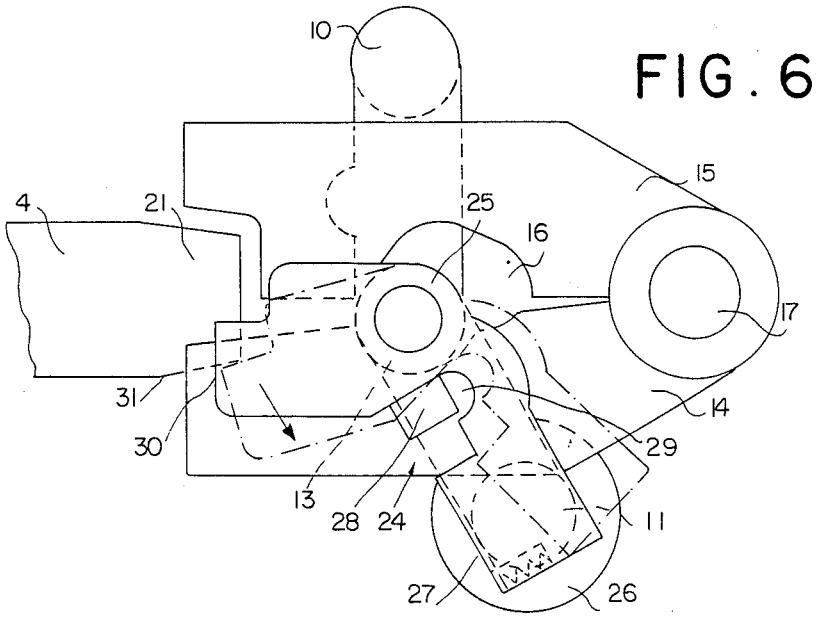
FIGS. 6 and 7 are top plan views showing the basic arrangement of a safety device for the trigger mechanism.
Figure 7:
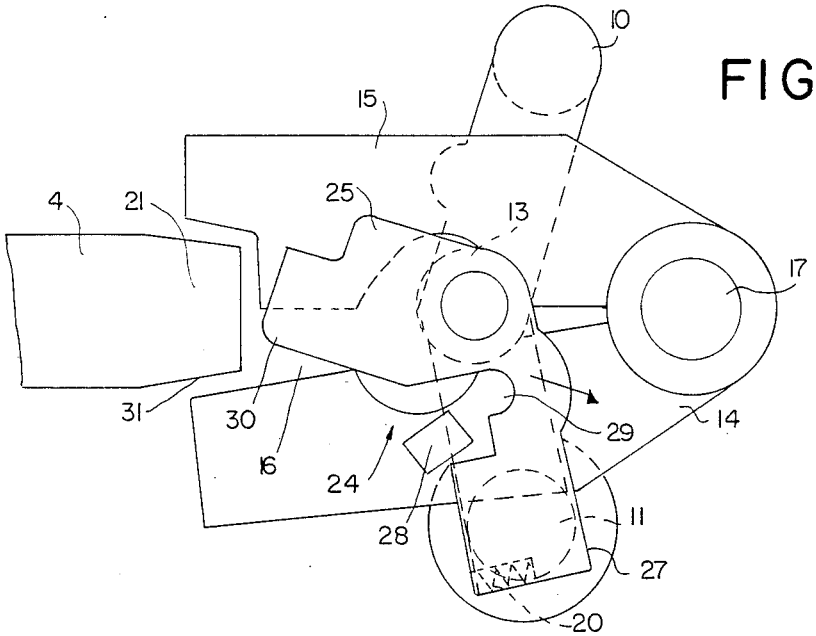

As is shown in FIGS. 6 and 7, an undesired movement of the release lever 14 by a shake can reliably be prevented in that a safety device 24 is provided, which mechanically locks the release lever 14 when it is in its initial position. That safety device comprises a two-armed locking lever 25, which is pivoted to the camming lever 10 on an axis which coincides with the axis of the camming roller 13. By a locking spring 26 the locking lever 25 is held in a locking position relative to the camming lever 10. In that locking position one lever arm 27 of the locking lever overlies and covers the camming lever, the pair of levers 14, 15 are in their initial position and a locking nose 28 of the release lever 14 is received and positively locked by an indentation 29 of the locking lever so that the latter is mechanically locked (FIG. 6). In that locking position the second lever arm 30 of the locking lever 25 protrudes into the path of the hammer extension 21. When the trigger is then pulled so that the camming lever 10 is pivotally moved. The locking lever 25 will positively be moved in unison with the camming lever 10 and the safety device will be disabled in time for a release of the release lever 14 (FIG. 7). Because that pivotal movement causes also the lever arm 30 to move out of the path of the hammer extension 21, the round will properly be discharged. Upon a release of the trigger, the camming lever 10 will return to its initial position and the detent mechanism comprising the locking nose 28 and the indentation 29 will interlock again. But during the reverse cocking movement of the hammer 4 the slip-off surface 31 which is provided on said hammer 4 and is associated with the lever arm 30 can effect a temporary unlocking in that the locking lever 25 is urged away against the force of the locking spring (position indicated in phantom in FIG. 6) so that the release lever 14 can be moved aside in spite of the safety device 24 and can then be pivotally moved until it is locked by the sustained-fire lever 6.

Because the pair of levers 14, 15 acting as a release member and a disconnector member are horizotally arranged and perform a scissorlike control movement and because the cam slot defined by the pair of levers and the camming member carried by the camming lever cooperate in a simple manner, the mechanism is robust and can economically be made and mainly distinguishes by a small overall height and a short overall length.

I claim:

1. In a hand-held automatic firearm comprising a receiver, a breechblock, which is reciprocably mounted in said receiver for forward and recoil movements, and a trigger mechanism mounted in said receiver and comprising a hammer spring, a hammer, which is pivoted to said receiver and arranged to be cocked against the force of said hammer spring by said breechblock during its recoil movement, a sustained-fire lever, which is controlled by the breechblock and arranged to lock the hammer when said hammer is cocked under control of the breechblock during its forward movement, a hammer extension, which is carried by said hammer and is movable by said hammer along a predetermined path, a trigger slider, which is slidably mounted in said receiver for a movement from an initial position through a single-shot position and further to a sustained-fire position, a trigger, which is pivoted to said receiver and operatively coupled to said trigger slider and is adapted to be pulled from an initial position to move said trigger slider from its initial position to said single-shot position and further to said sustained-fire position, a trigger spring urging said trigger slider and said trigger to their respective initial positions, and a pair of levers, which respectively comprise a release lever and a disconnector lever and are movable each into said predetermined path to a catching position in response to the movement of said trigger slider to either of said single-shot and sustained-fire positions, the improvement residing in that said release lever and said disconnector lever are pivoted on to said receiver on a common upright vertical axis and have confronting camming side edges, which define between them a cam slot, a camming member is movably mounted in said receiver and is coupled to said trigger slider and is arranged to perform in response to pulling of said trigger a movement relative to said camming edges in engagement therewith and by said movement to impart to said pair of levers in dependence on one of the aforementioned positions assumed by said trigger slider, a movement of said pairs of levers from an initial position to a single-shot position when said trigger slider is in its single-shot position and to a sustained-fire position when said trigger slider is in its sustained-fire position, a restoring spring is operatively connected to said pair of levers and urges them to their initial position, said release lever is arranged to engage said hammer extension when said pair of levers are in their initial position and said hammer is cocked and to release said hammer extension when said pair of levers are in their single-shot position, said disconnector lever is arranged to extend into said predetermined path when said pair of levers are in their sustained-fire position.

2. The improvement set forth in claim 1, wherein said trigger slider is formed with a coupling slot and said camming member is mounted on a camming lever, which has a first end that is pivoted on an axis which is parallel to said common upright vertical axis of the pair of levers and a second end which extends into said coupling slot.

3. The improvement set forth in claim 1, wherein said camming member is a roller.

4. The improvement set forth in claim 1, wherein said release lever has a catching surface which is engageable with said hammer extension and said disconnector lever has a catching surface which is engageable with said hammer extension and is offset from said catching surface of the release lever in a direction in which said hammer is adapted to be cocked.

5. The improvement set forth in claim 1, wherein said restoring spring comprises a torsional coil spring, which urges the levers of said pair toward each other and a safety device is provided for locking said release lever in its position corresponding to the initial position of said pair of levers.

6. The improvement set forth in claim 5, wherein said trigger slider is formed with a coupling slot, said camming member is mounted on a camming lever, which has a first end that is pivoted on an axis which is parallel to said common upright vertical axis of the pair of levers and a second end which extends into said coupling slot, said safety device comprises a two-armed locking lever, which is mounted to said camming lever for pivotal movement in first and second directions, stop means are provided for limiting the pivotal movement of said locking lever, spring means are provided, which oppose the pivotal movement of said locking lever in said first direction, said locking lever comprises first and second lever arms, said first lever arm protrudes into said predetermined path, said hammer extension has a slip-off surface which faces away from said breechblock, and said second lever arm carries locking means for interlocking with said release lever when said release lever is in a position corresponding to the initial position of said pair of levers.

* * * * *